United States Patent [19]

Kurbikoff et al.

[11] Patent Number: 4,521,062

[45] Date of Patent: Jun. 4, 1985

[54] ELECTRICAL CONNECTOR WITH OPTIONAL GROUNDING ELEMENT

[75] Inventors: Peter A. Kurbikoff, Agoura; Gary C. Bethurum, El Segundo, both of Calif.

[73] Assignee: International Telephone and Telegraph Corporation, New York, N.Y.

[21] Appl. No.: 517,196

[22] Filed: Jul. 26, 1983

[51] Int. Cl.[3] ..... H01R 4/66; H01R 13/648

[52] U.S. Cl. ..... 339/14 R; 339/143 R; 339/17 LC

[58] Field of Search ..... 339/14 R, 17 LC, 136 R, 339/136 M, 138, 139 R, 139 C, 143 R

[56] References Cited

U.S. PATENT DOCUMENTS

| | | | |
|---|---|---|---|
| 2,790,153 | 4/1957 | Arson | 339/139 C X |
| 3,535,676 | 10/1970 | Schultz, Sr. | 339/143 R |
| 3,879,099 | 4/1975 | Shaffer | 339/138 X |
| 4,337,989 | 7/1982 | Asick et al. | 339/143 R |
| 4,418,972 | 12/1983 | Benasutti | 339/176 MP X |
| 4,457,575 | 7/1984 | Davis et al. | 339/143 R |

*Primary Examiner*—John McQuade
*Assistant Examiner*—Steven C. Bishop
*Attorney, Agent, or Firm*—T. L. Peterson; R. C. Turner; J. M. May

[57] ABSTRACT

A shell-less connector member having an optional grounding shell bracket mounted on the forward mating portion of the connector member. The connector member may be intermated with a standard metal shell connector member or, when the grounding bracket is removed, with the mating shell-less connector member.

10 Claims, 10 Drawing Figures

ELECTRICAL CONNECTOR WITH OPTIONAL GROUNDING ELEMENT

BACKGROUND OF THE INVENTION

The present invention relates generally to an electrical connector and, more particularly, to a shell-less insulative connector member which may optionally be provided with a grounding shell bracket.

There are basically two different types of electrical connectors. In one type of connector, a metal shell surrounds an insulative insert in which the contacts of the connector are mounted. In the other type of connector, the entire body of the connector is formed of an insulative material. There is no metal shell surrounding the body of the connector. Such connectors are often referred to as being shell-less connectors or all-plastic connectors. There is presently available on the market a variety of connectors sometimes referred to as being D-subminiature connectors in which the plug connector half has a keystone shaped forward polarization portion which engages within a matching keystone shaped recess in the mating connector half. Such connectors are available in both the shell and shell-less forms, and the plug connector half of one of such connectors is intermateable with the receptacle half of the other type of connector, and vice versa.

The shell-less or all-plastic connectors have the advantage of being of lower cost than the metal shell connectors. However, because such connectors do not embody a metal shell, they are not capable of being grounded which may be necessary for some applications.

It would therefore be desirable to provide for a shell-less connector member a grounding shell bracket which will allow the connector member to be interengaged with a mating standard metal shell connector member with a grounding connector therebetween, yet when the bracket is removed, the shell-less connector member may still interengage with its mating shell-less connector member. It is the object of the present invention to provide a shell-less connector member with an optional grounding shell bracket which will allow mating with the two different types of connector members as described hereinabove.

SUMMARY OF THE INVENTION

According to a principal aspect of the present invention there is provided an electrical connector member which is adapted to mate with a second connector member which is either shell-less or embodies a conductive shell for electrical grounding purposes. The connector member of the invention comprises a shell-less insulative connector body having a forward mating end. A grounding element, which may be in the form of a grounding shell bracket, borders the periphery of the forward portion of the connector body adjacent to its forward mating end. Openings are formed in the wall of the grounding element. Projections on the connector body extend into the openings. The outer surfaces of the projections are substantially flush with exposed surface of the grounding element. The outer surfaces of the projections and the exposed surface of the grounding element are dimensioned to slidably interengage with the forward mating end of the mating connector member of the connector assembly, regardless whether the mating connector member is a shell-less connector member or a standard metal shell connector member.

Because the outer surfaces of the projections have a normal sliding fit with the mating connector member, the connector member of the invention may interengage with the mating connector member in a close sliding fit even though the grounding element is not mounted on the first connector member. Thus, with the grounding element mounted on the shell-less connector member of the present invention, such member may be mated with a standard metal shell connector member so that both electrical connector members may be grounded, if desired, and alternatively the grounding element may be eliminated from the connector body of the connector member of the invention without impairing the ability of the connector member to be interengaged with a mating shell-less connector member.

DESCRIPTION OF THE PREFERRED EMBODIMENTS

Figure 1:
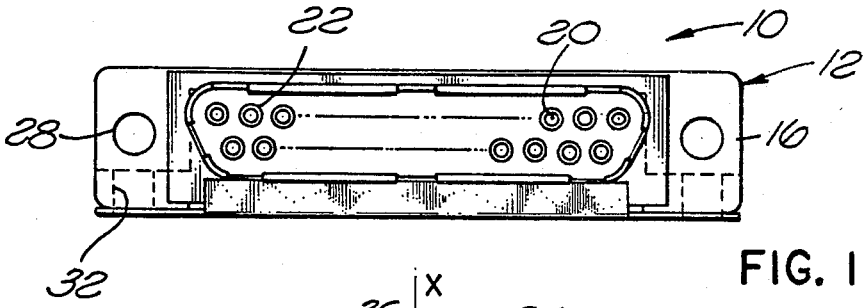
FIG. 1 is a front end view of one embodiment of the plug connector member of the present invention embodying an optional grounding shell bracket.
Figure 2:
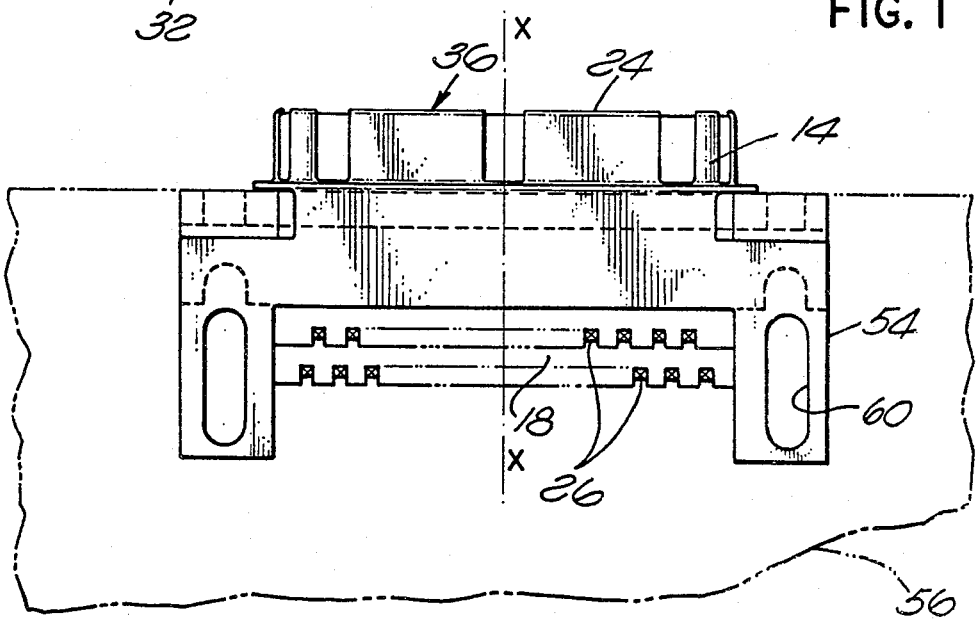
FIG. 2 is a bottom view of the plug connector member illustrated in FIG. 1.
Figure 3:
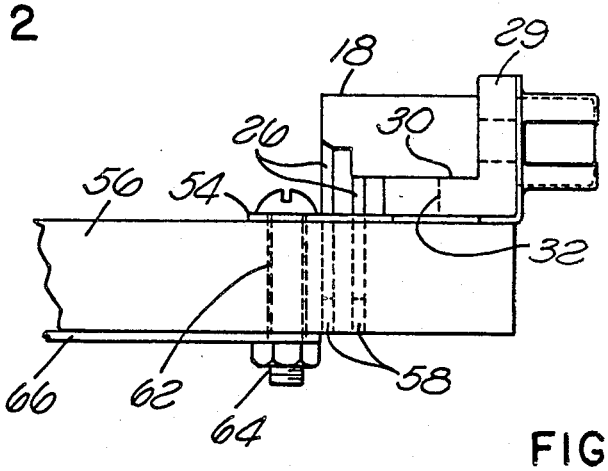
FIG. 3 is a side view of the plug connector member illustrated in FIGS. 1 and 2, with the connector member shown mounted on a printed circuit board.

Referring now to FIGS. 1 to 5 of the drawings in detail, there is illustrated one embodiment of the connector member of the present invention, generally designated 10, which is in the form of a shell-less or all-plastic plug connector member. The connector member comprises an insulative body 12 having a front portion 14, a mounting flange 16 and a rear portion 18. The front portion 14 is of generally keystone configuration for polarization when fitted into a keystone shaped recess of a mating receptacle connector member, not shown. Socket contacts 20 are mounted in two rows of contact passages 22 which open at the forward mating end 24 of the connector body. The forward mating end 24 is normal to the center axis X—X of the connector body. (see FIGS. 2 and 4). Each contact has a rearwardly extending post 26 which is bent at a right angle and extends downwardly from the rear portion 18 of the connector body as seen in FIG. 3.

Figure 4:
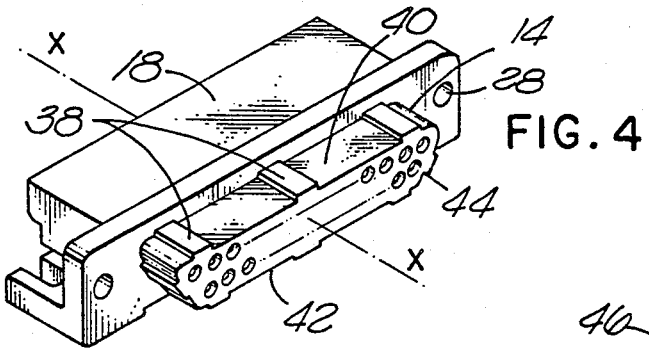
FIG. 4 is a perspective view of the shell-less insulative connector body utilized in the plug connector member illustrated in FIGS. 1 to 3.
Figure 5:
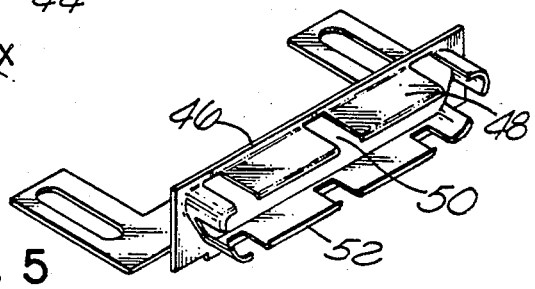
FIG. 5 is a perspective view of the grounding shell bracket utilized in the plug connector member illustrated in FIGS. 1 to 3.

The mounting flange 16 has a generally L-shaped configuration on the opposite sides of the connector body as best seen in FIGS. 3 and 4. Holes 28 are formed in the vertical portions 29 of the flange 16 to allow mounting of the connector in a vertical mounting panel. The flange also includes a horizontal section 30 on the opposite sides of the connector body in which there are formed notches 32 which may receive fasteners for securing the connector on a board or panel underlying the connector member.

According to the invention, an optional grounding shell bracket 36 is mounted on the front portion 14 of the connector body which will allow the plug connector member 10 to be mated with a standard metal shell receptacle connector member, not shown, so that the two connector members may be grounded, yet if the grounding shell bracket is eliminated, the plug connector member may still be interengaged with a shell-less receptacle connector member. To this end, as best seen in FIG. 4, there is provided a plurality of longitudinally extending projections or ribs 38 on the top surface 40 and bottom surface 42, of the front keystone portion 14 of the connector body, as well as on the angular end surfaces 44 thereof. In the embodiment of the invention illustrated in FIGS. 1 to 4, there is provided three ribs on both the top and bottom surfaces 40 and 42, respectively, and one rib on each of the angular end surfaces 44. Obviously any number of ribs may be provided depending upon the size and width of the connector member. Each rib 38 extends from the mounting flange 16 to the front mating end 24 of the connector body. The outer surfaces of the ribs are dimensioned to have a close sliding fit within a keystone shaped recess formed in the mating receptacle connector member.

The grounding bracket of the invention comprises an outwardly extending flange 46 which surrounds the front portion 14 of the connector body immediately adjacent to the mounting flange 16, and a plurality of forwardly extending resilient contacting fingers 48 which are located around the flange 46 in a position to lie within the grooves defined between the ribs 38 formed on the front portion of the connector body. The longitudinally extending slots 50 which are formed between the contacting fingers 48 of the grounding bracket extend rearwardly through the flange 46 so that the bracket may be slideably fit over the front portion 14 of the connector body from the front thereof. Preferably the forward ends 52 of the contacting fingers 48 are turned inwardly slightly to provide inwardly extending lips which facilitate insertion of the plug connector member 10, with a grounding bracket mounted thereon, into a mating standard metal shell receptacle connector member. The thickness of the contacting fingers 48 is such that the outer surfaces of the fingers are substantially flush with the outer surfaces of the ribs 38 to thereby provide a substantially continuous outer surface around the front portion of the plug connector member. If desired, thin webbs, not shown, may interconnect the fingers 48 at their forward ends to provide the grounding bracket with greater rigidity.

In the embodiment of the invention illustrated in FIGS. 1 to 5, the grounding bracket 36 is provided with a pair of mounting arms 54 which extend rearwardly from the sides of the mounting bracket underneath the horizontal sections 30 of the mounting flange of the connector body. Thus, when the connector member 10 is mounted on a printed circuit board 56, as illustrated in FIG. 3, the mounting arms 54 will be disposed between the connector body 12 and the board. With the connector mounted in such fashion, the terminal posts 26 of the contacts in the connector will extend into two rows of holes 58 formed in the printed circuit board 56. The mounting arms 54 are formed with elongated slots 60 which are aligned with a pair of holes 62 formed in the printed circuit board. Suitable fasteners 64 extend through the slots 60 in the mounting arms into the holes 62 to secure the connector assembly on the printed circuit board, and also to provide a grounding connection between the bracket 36 and a grounding strap 66, for example, mounted on the bottom of the board.

Figure 6:
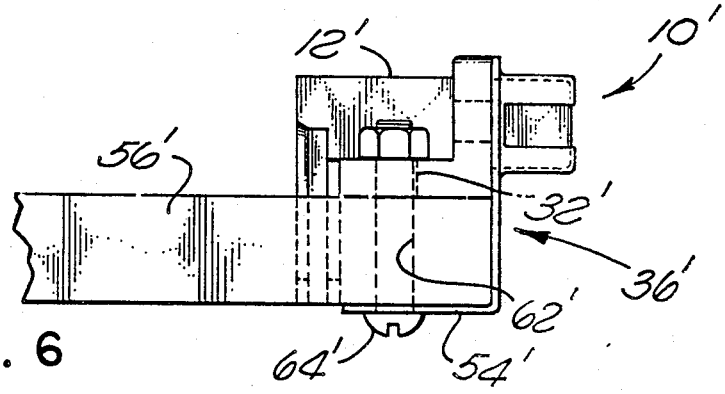
FIG. 6 is a side view of a second embodiment of the plug connector member of the invention shown mounted on a printed circuit board.

Referring now to the embodiment of the invention illustrated in FIG. 6, a plug connector member 10′ is shown which is essentially identical to the plug connector member 10, except that the mounting arms 54′ on the grounding bracket 36′ are spaced below the bottom of the connector body 12′ so that the printed circuit board 56′ will be disposed between the connector body and the mounting arms. In this arrangement, the fasteners 64′ extend upwardly through slots in the mounting arms 64, holes 62′ in the printed circuit board and notches 32′ in the grounding bracket. By this arrangement, by removing the fasteners 64′, the grounding bracket 36′ may be removed from the connector body 12′ without removing the terminal posts 26′ from the printed circuit board.

Figure 7:
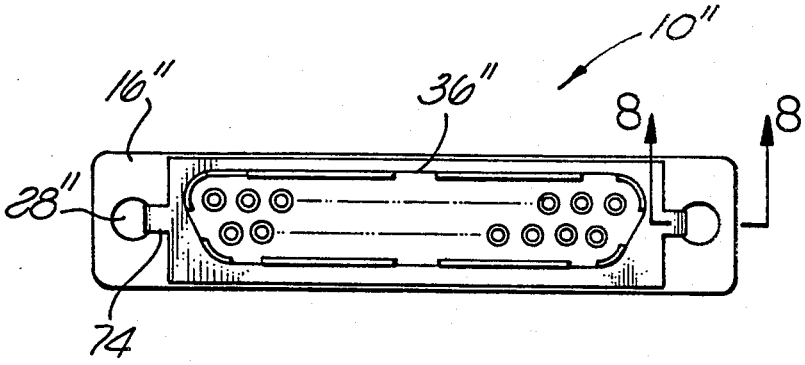
FIG. 7 is a front end view of a third embodiment of the plug connector member of the present invention.
Figure 8:
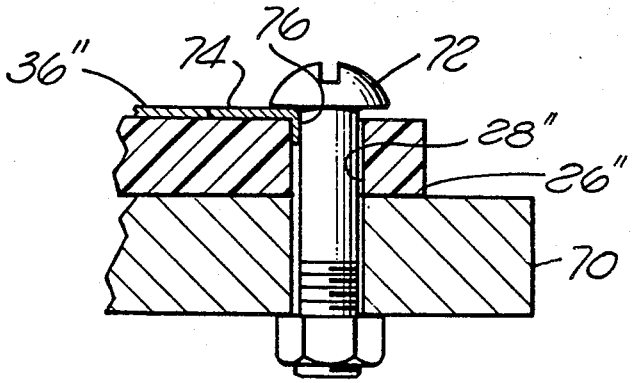
FIG. 8 is a fragmentary sectional view taken along line 8—8 of FIG. 7.

In the embodiment of the invention illustrated in FIGS. 7 and 8, the plug connector member 10″ is essentially the same as the plug connector member 10 except that the grounding bracket 36″ does not include the mounting arms 54 for mounting onto a printed circuit board. Instead, in this embodiment of the invention the plug connector member is adapted to be mounted on a mounting panel 70 by fasteners 72 extending through holes 28″ in the mounting flange 16″ of the connector body. The grounding bracket 36″ is formed with grounding tabs 74 which extend outwardly to the holes 28″. Each tab includes an inwardly extending lip 76 which is firmly engaged by the fasteners 72 when the latter are mounted through the holes in the mounting flange of the connector body and the mounting panel to secure the two parts together. In this case the mounting panel may be formed of metal so that there is a grounding connection provided from the grounding bracket 36″ to the mounting panel 70 via the tabs 74 and fasteners 72.

Figure 9:
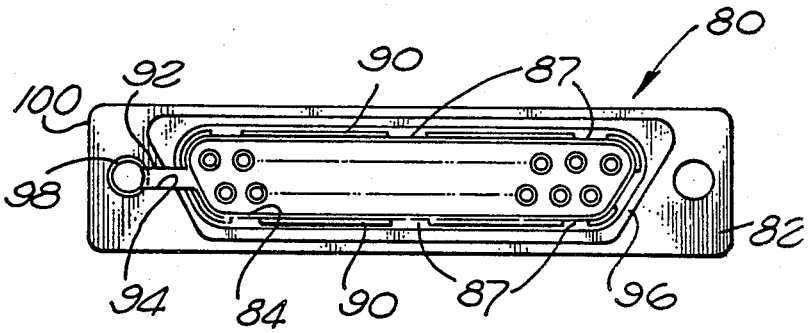
FIG. 9 is a front end view of a receptacle connector member embodying an optional grounding shell bracket.
Figure 10:
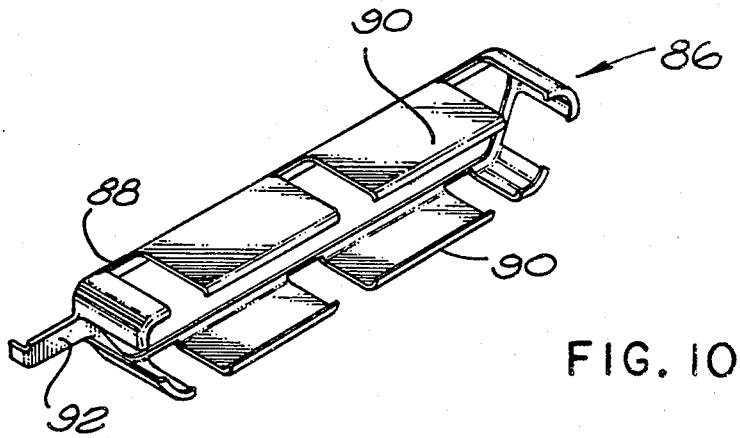
FIG. 10 is a perspective view of the grounding shell bracket utilized in the receptacle connector member illustrated in FIG. 9.

Reference is now made to FIGS. 9 and 10 of the drawings which illustrate the invention incorporated into a receptacle connector member, rather than a plug connector member. In this embodiment, the receptacle connector member 80 comprises a shell-less insulative connector body 82 having a keystone shaped recess 84 therein for receiving the forward mating portion of a plug connector member. The grounding bracket 86 is mounted within the recess 84, rather than surrounding a front keystone portion as in the plug connector member illustrated in FIGS. 1 to 8. Longitudinally extending spaced ribs 87 are formed around the inner periphery of the recess 84. The bracket includes a rear mounting flange portion 88 and a plurality of forwardly extending resilient contacting fingers 90 which fit within the slots defined between the ribs 87 when the bracket is pushed inwardly into the recess 84 in the connector body. The exposed inner surfaces of the contacting fingers 90 are essentially flush with the outer surfaces of the ribs 87 and such surfaces of the fingers and ribs are dimensioned so that the front keystone shaped portion of a mating standard metal plug connector member will have a close sliding fit within the interior of the receptacle connector member so that the grounding bracket on the receptacle member and the shell of the plug connector member will be electrically interconnected. An outwardly extending tab 92 is formed on the bracket 86. The tab extends outwardly through a slot 94 opening to the forward mating end of the front part 96 of the connector body 82 to a mounting hole 98 formed in the mounting flange 100 of the receptacle connector member in a manner similar to that shown in FIG. 8. It will be appreciated that by removing the grounding bracket 86 from the receptacle connector member 80, the connector member may still be mated with a shell-less plug connector member because of the close sliding fit provided between the ribs 87 in the receptacle connector member and the outer surface of the front keystone shaped portion of the mating plug connector member.

Thus, in each embodiment of the invention disclosed herein, the user will have the option of incorporating a metal grounding bracket on a shell-less connector body which may be interengageable with a mating standard metal shell connector member, or to eliminate the grounding bracket so that the connector member may be interengaged with a mating connector member with or without a standard metal shell.

What is claimed is:

1. An electrical connector member adapted to mate with a second connector member which is either shell-less or embodies a conductive shell, and has a recess formed in its forward mating end, comprising:

a shell-less insulative connector body having a plurality of projections spaced about its outer periphery adjacent to the forward mating end of the connector body;

the horizontal and vertical dimensions of said connector body as defined by the outer surfaces of said projections being selected to permit a sliding fit of the connector body into the recess of the second connector member;

a metal grounding element substantially surrounding said connector body adjacent to said forward mating end thereof; and said grounding element having openings therein receiving said projections, said grounding element being dimensioned to have a sliding fit within said recess whereby, if said second connector member has a conductive shell, said grounding element and the shell will be electrically connected when the two connector members are mated.

2. An electrical connector member as set forth in claim 1 wherein:

said openings in said grounding element open to the rear of said element whereby said element may be slidably fit over said connector body from the front thereof.

3. An electrical connector member as set forth in claim 1 wherein:

the thickness of the wall of said grounding element is essentially the same as the height of said projections.

4. An electrical connector member as set forth in claim 1 wherein:

said grounding element embodies a mounting bracket extending outwardly from said connector body.

5. An electrical connector member as set forth in claim 1 wherein:

said connector body has a generally keystone configuration having elongated, generally parallel top and bottom surfaces and a pair of angular end surfaces; and said projections are formed on each of said surfaces.

6. An electrical connector member as set forth in claim 1 wherein:

said grounding element embodies an outwardly extending flange; and said openings in said grounding element open to the rear of said element through said flange.

7. An electrical connector member as set forth in claim 1 wherein:

said connector body has an outwardly extending mounting flange thereon having at least one fastener receiving hole therein; and said grounding element includes a tab extending outwardly to said hole.

8. An electrical connector member adapted to mate with a second connector member which is either shell-less or embodies a conductive shell, and has a recess formed in its forward mating end, comprising:

a shell-less, keystone shaped insulative connector body having generally parallel top and bottom surfaces and a pair of angular end surfaces, said connector body having a plurality of ribs spaced about its outer periphery adjacent to the forward mating end of the connector body;

the horizontal and vertical dimensions of said connector body as defined by the outer surfaces of said ribs being selected to permit a sliding fit of the connector body into the recess of the second connector member;

a metal grounding element substantially surrounding said connector body adjacent to said forward mating end thereof;

said grounding element having slots therein receiving said ribs, said grounding element being dimensioned to have a sliding fit within said recess whereby, if said second connector member has a conductive shell, said grounding element and the shell will be electrically connected when the two connector members are mated; and said slots in said grounding element opening to the rear of said element whereby said element may be slidably fit over said connector body from the front thereof.

9. An electrical connector member as set forth in claim 8 wherein:

said ribs are formed on each of said four surfaces of said connector body.

10. An electrical connector member comprising:

a shell-less insulative connector body having a forward mating end;

said connector body having a recess formed in said forward mating end;

a grounding element bordering the wall of said recess adjacent to said forward mating end;

openings in the wall of said grounding element; and projections on said connector body extending inwardly into said openings and having outer surfaces substantially flush with the exposed inner surface of said grounding element.

* * * * *